US005827419A

United States Patent [19]

Marsal et al.

[11] Patent Number: 5,827,419

[45] Date of Patent: Oct. 27, 1998

[54] CONTINUOUS PROCESS FOR THE ELECTROGALVANIZING OF METAL STRIP IN A CHLORIDE-BASED PLATING SOLUTION IN ORDER TO OBTAIN COATINGS WITH LOW RUGOSITY AT HIGH CURRENT DENSITIES

[75] Inventors: Joël Marsal, Vigy; Nicolas Kopytowski, Hayange; Alain Bello, Hettange-Grande; Marie Lombardi, Thionville; Isabelle Marolleau, Basse Ham, all of France

[73] Assignee: Sollac (Societe Anonyme), Puteaux, France

[21] Appl. No.: 618,805

[22] Filed: Mar. 20, 1996

[30] Foreign Application Priority Data

Mar. 29, 1995 [FR] France ..... 95 03640

[51] Int. Cl.[6] ..... C25D 7/06; C25D 3/22

[52] U.S. Cl. ..... 205/141; 205/138; 205/305

[58] Field of Search ..... 204/206; 205/141, 205/148, 155, 138, 305

[56] References Cited

U.S. PATENT DOCUMENTS 4,519,878 5/1985 Hara et al. ..... 205/141
5,344,552 9/1994 Marolleau et al. ..... 205/138

FOREIGN PATENT DOCUMENTS 538081 4/1993 European Pat. Off. .

OTHER PUBLICATIONS

F.A. Lowenheim, Electroplating, McGraw–Hill Book Co., New York, 1978, pp. 143–144.

*Primary Examiner*—Kathryn L. Gorgos
*Assistant Examiner*—William T. Leader
*Attorney, Agent, or Firm*—Sixbey Friedman Leedom & Ferguson; Thomas W. Cole

[57] ABSTRACT

An electrogalvanizing process, in which a strip is moved past an anode, plating solution is made to flow at a speed V with respect to the moving strip, and an electric current of current density J greater than 50 A/dm$^2$ is passed between the strip and the anode, which comprises carrying out the deposition under conditions such that:

$J/J_{lim}$ is less than or equal to 0.15;

$J^2/J_{lim}$ is less than or equal to 22 A/dm$^2$;

where $J_{lim}$ is the limiting current density, corresponding to the current density plateau in the current versus potential curve characteristic of the plating solution flowing at the speed V in the vicinity of the strip. An electroplating cell of the radial type for implementing the process, in which cell the anode bed is continuous, is disclosed. The process facilitates the high-speed deposition of zinc which has low rugosity and is free of edge dendrites.

2 Claims, 5 Drawing Sheets

CONTINUOUS PROCESS FOR THE ELECTROGALVANIZING OF METAL STRIP IN A CHLORIDE-BASED PLATING SOLUTION IN ORDER TO OBTAIN COATINGS WITH LOW RUGOSITY AT HIGH CURRENT DENSITIES

FIELD OF THE INVENTION

The invention relates to an electrolytic process for the high-speed deposition of zinc with low surface rugosity.

PRIOR ART

It is known that, after a coating of zinc has been electroplated onto the surface of a steel sheet, the rugosity of the surface after deposition is different from the rugosity of the surface prior to deposition.

Thus, an increase in rugosity after electrodeposition of zinc is generally observed, especially when plating solutions containing chlorides are used and especially when the process operates at high current densities, for example greater than 50 A/dm$^2$. This increase in rugosity, or "rugosity increment", may reach 0.5 micrometers in terms of the arithmetic rugosity (generally denoted by Ra).

Conventionally, the rugosity is calculated from averages of several profilometer readings or "profiles"; each profile, during recording, is filtered by means of an electronic high-pass filter reducing the amplitude of the undulations exceeding the filtering threshold to 75% of its value in the profile before filtering; the filtering threshold is, for example, 0.8 mm; the vertical spread in this profile may be represented by the distribution of its depth relative to a given reference line. According to the French Standard (AFNOR EO5.015/017/052), this reference line (Ox) is the straight line taken parallel to the general direction of the profile and passing through its top points. Along the ordinate axis (Oz), which is drawn through O perpendicular to Ox, are plotted the depths of the profile. The deviation of the rugosity profile with respect to the reference line Ox may be regarded as a random variable. In this case, the set of deviations or depths forms a certain statistical distribution. Thus, the position of the mean line of the profile and the arithmetic mean deviation of the depth with respect to the mean line, which represents the arithmetic rugosity Ra, are measured.

In order to obtain electroplated deposits which give only a slight rugosity increase, the so-called "rugosity increment", it is known to introduce grain-refining agents, which may be based on polyethylene glycol for example, into the plating solution.

However, these grain-refining agents have the drawback of causing random crystallization of the coating and of degrading the state of the edges of the strip to be coated.

Patent FR 2,682,290 describes a process for continuously electroplating metal onto a strip, enabling a small rugosity increment to be obtained while forming an electroplated deposit which adheres strongly and has good cohesion. In this process, in which the strip moves successively past several anodes or anode panels and in which a high electric current is passed between these anodes or anode panels and the strip forming the cathode, a much lower current density is applied at the final anode than at the preceding anodes.

Thus, a sheet having an arithmetic rugosity of 1.3 microns before deposition can be coated with a layer of zinc 7.5 microns in thickness and only have, after deposition, a rugosity of 1.4 microns, i.e. a rugosity increment of only 0.1 microns, by virtue of the invention according to document FR 2,682,290.

However, this process requires accepting a reduction in the efficiency at the last anodes or the last cells of an electroplating line since the current density, and therefore the amount of material electroplated, is lessened there.

In the rest of the document, the term anode will be used imprecisely to designate an anode itself or an anode panel which may, for example, be composed of several contiguous plates side by side and all connected to the same electrical supply terminal.

Correlatively with the rugosity increase, during continuous electrodeposition onto a metal strip, dendrites appear on the edges of the strip, especially when the process is carried out in a chloride-based plating solution.

These edge dendrites correspond to a coating overcharge, with respect to the mean thickness deposited on the rest of the strip, and to a deposit having high rugosity and poor adhesion.

In addition to them therefore constituting a deposition heterogeneity, these dendrites are also troublesome since they sometimes become detached from the strip during the process, foul the electroplating means and even the strip itself (the phenomenon of "smearing").

It is known that the appearance of these dendrites increases with the plating current density and therefore with the rate of deposition. It therefore is a critical phenomenon in industrial electroplating lines.

SUMMARY OF THE INVENTION

The object of the invention is to limit the surface rugosity increment of a metal strip during electrogalvanizing, especially in a chloride environment, while at the same time using electroplating plants to the best of their efficiency and their performance capabilities, especially at high current densities.

The object of the invention is also to limit, or indeed prevent, the appearance of strip-edge dendrites during electrogalvanizing, even at high current densities.

The subject of the invention is a process for the continuous electrogalvanizing of metal strip in a chloride-based plating solution, in which said strip is moved past an anode, said solution is made to flow at a speed V through the gap separating said strip from said anode, the speed V being measured with respect to said moving strip, and an electric current corresponding to a current density J greater than 50 A/dm$^2$ is passed between said strip forming the cathode and said anode, wherein the deposition is carried out under conditions such that:

$J/J_{lim}$ is less than or equal to 0.15;

$J^2/J_{lim}$ is less than or equal to 22 A/dm$^2$;

where $J_{lim}$ is the limiting current density, corresponding to the current-density plateau in the "current v potential" curve characteristic of said plating solution flowing at the speed V in the vicinity of the strip.

It is known that $J_{lim}$ also corresponds to the current density for which the local concentration of zinc ions in the solution becomes zero in the immediate vicinity of the strip to be coated.

$J_{lim}$ also corresponds to the current density above which electrochemical phenomena other than the reduction of zinc ions take place, especially hydrogen evolution.

$J_{lim}$ therefore also corresponds to the current density above which the electrochemical zinc deposition efficiency drops appreciably.

Within the range of possible values of the solution in the vicinity of the substrate to be coated in industrial electrogalvanizing cells, it has been observed that $J_{lim}$ may be calculated from the expression: $J_{lim}=A\times V$, where V is the average speed of flow of the electrolyte between the moving strip and the groups of anodes and where A is a constant factor whose value depends only on the electrogalvanizing solution.

According to this observation, determination of $J_{lim}$ amounts to determination of the factor A.

The constant factor A depends especially on the composition, the temperature and the viscosity of the solution.

An experimental method for determining the factor A is given here by way of non-limiting example.

The factor A may be experimentally determined from tests carried out on a laboratory scale of the same electrogalvanizing solution, using the method, known per se, called the "Levich line" method.

This method is based on electrogalvanizing tests on a rotating metal disk in an electrogalvanizing solution opposite a fixed anode; it is known that, if ω is the speed of rotation of the disk, $J_{lim}$, the limiting current density, may be expressed in the form of $J_{lim}=k\times\sqrt{\omega}$; the electrogalvanizing tests enable the value of k which depends on the electrogalvanizing solution to be determined experimentally.

Thus, for an electrogalvanizing test at a predetermined speed of rotation ω, the polarization curve called the "current v potential" curve, is plotted; on this curve, representing the current density J as a function of the voltage U applied between the anode and the rotating disk, the position of the first current-density plateau indicates the value of $J_{lim}$ for the predetermined speed ω.

Moreover, between a metal disk rotating at the speed ω in a solution and a metal strip moving in a solution at a strip/electrolyte relative speed V, it is known that the hydrodynamic conditions are comparable when V and ω satisfy the equation $V=k'\sqrt{\omega}$; when V and ω are expressed in m/min and revolutions/min, respectively, for a disk having an area of 0.1 $cm^2$, $k'=2.97$ m/(min.)$^{0.5}$.

Thus, the factor A therefore equals k/k'.

The set of deposition conditions according to the invention may be represented on a diagram showing the current density J of the deposition as abscissa and the limiting current density $J_{lim}$ of the solution as ordinate, as shown in FIG. 1, in which the hatched part represents the set of deposition conditions according to the invention.

In order to implement the invention, an industrial electrogalvanizing plant is conventionally used which includes a succession of electroplating cells provided with anodes and containing the electrogalvanizing solution, means for moving the metal strip to be coated past the anodes at a predetermined speed Vd, means for passing an electric current of current density J between the moving strip and the anodes and means for making the plating solution flow at a predetermined speed Vg as a counterflow to the movement of the strip in the gap separating the anodes from the moving strip.

Thus, the average speed of flow V of the electrolyte between the moving strip and the groups of anodes is the sum of the speed of movement of the strip Vd and the speed of flow of the counterflowing solution Vg.

Therefore, V=Vd+Vg.

In practice and in a manner known per se, the choice of the deposition conditions in the industrial electrogalvanizing plant depends on the desired thickness of zinc, called e.

The thickness e is proportional to the current density J and to the time for the strip to pass through the plant, which is itself inversely proportional to the strip speed Vd.

Thus, determination of the strip speed Vd depends on the thickness e to be deposited onto the strip and on the current density J.

Therefore $Vd=f(e)\times J$, where f(e) is a function which depends on the thickness e.

The speed V is then expressed by $V=f(e)\times J+Vg$.

The equation $J_{lim}=A\times V$ is then expressed in the form $J_{lim}=A\times Vg+A\times f(e)\times J$ and is represented by a straight line, called the "operating" line in the diagram of the deposition conditions; the ordinate at the origin of this straight line equals A×Vg which is characteristic of the electrogalvanizing solution through the factor A and of the speed of flow of the counterflowing solution Vg.

In practice, because of the operating limits of the industrial electrogalvanizing plant, the set of deposition conditions according to the invention is limited, in addition to the conditions shown in FIG. 1 which are specific to the invention, by the following conditions:

- the current density J for the deposition must remain less than a maximum current density $J_{max}$; in fact, if the maximum current which is capable of delivering the electrical supply in an industrial electrogalvanizing plant is termed $I_{max}$, if the total immersed strip length facing the anodes in the electrogalvanizing solution in said plant when operating is termed Lc and if the width of the strip to be coated on one face in said plant is termed Lb, then $J_{max}=I_{max}/(Lc\times Lb)$;
- the limiting current density $J_{lim}$, which is a function of the solution (factor A), of the hydrodynamic flow conditions in the solution (speed Vg) and of the desired coating thickness e, through the equation already mentioned, $J_{lim}=A\times Vg+A\times f(e)\times J$, must remain less than a maximum value corresponding to a maximum speed of flow $Vg_{max}$ of the counterflowing solution.

The maximum limiting current density $J_{lim.max}$ is calculated from the equation $J_{lim.max}-A\times Vg_{max}+A\times f(e)\times J$, where $Vg_{max}$ is the maximum speed of flow of the solution allowed by the electrogalvanizing plant, taking into account the geometrical characteristics of the cells and the characteristics and output limits of the means for making the solution flow.

The set of deposition conditions according to the invention is thus restricted to a narrower range, shown in FIG. 2 by a hatched area, as per the same conventions as in FIG. 1.

The position of the straight line $J_{lim.max}=A\times Vg_{max}+A\times f(e)\times J$, which limits this range depends on the following elements.

In order to implement the invention with regard to electrogalvanizing in the chloride-based solutions, it is known that the anodes of industrial plant cells are soluble.

Since the anodes are soluble, it is necessary to be able to interchange them easily, even during deposition operations.

In radial-type cells, in which the strip is supported by a roller immersed in the plating solution, several successive anode panels in the form of a circular arc are generally used in order to match the shape of the roller.

Thus, the anodes of the cell are generally interchanged by shifting them transversely with respect to the direction of movement of the strip, and therefore toward the sides of the immersed roller.

The various soluble-anode panels of a radial cell are generally not contiguous, especially so as to facilitate anode changes independently of one another; thus, two successive anode panels are generally separated by a narrow window which has a width, in the direction of movement of the strip, generally of about 30 cm.

Thus, the succession of anode panels does not form a continuous surface; it is therefore said that the soluble anode "bed" of a radial cell is generally not continuous.

When the plating solution is made to flow at the speed Vg through the gap separating the anodes of a strip to be coated, the solution has a tendency to escape via these narrow windows.

In an industrial plant having radial cells with noncontiguous soluble anode panels, it is conventional to use several injection rails as the means for making the plating solution flow at a predetermined speed Vg as a counterflow to the movement of the strip.

These solution injection rails are arranged in these narrow windows between the anode panels and at least one injection rail is arranged at the last anode on the side where the exiting strip emerges from the plating solution, for example as described in document U.S. Pat. No. 4,500,400.

These conventional means for making the solution flow are fed by pumps capable of delivering a maximum total output $QP_{max}$.

The total output of the pumps Qp is distributed between the various injection rails and the output of each rail determines the speed of flow Vg of the solution.

Thus, the maximum speed of flow $Vg_{max}$ is directly proportional to $QP_{max}$ and depends on the number of rails.

The value of $QP_{max}$ and the number of rails make it possible to determine the position of the straight line $J_{lim.max}=A\times Mg_{max}+A\times f(e)\times J$ which limits the range of deposition conditions.

In conventional industrial plants, it may happen that the range of deposition conditions is too narrow, or is nonexistent, especially because the maximum total output $QP_{max}$ of the pumps is not high enough.

It is then possible to carry out deposition without the risk of there being too high a rugosity increment or edge dendrites.

In order to operate the process according to the invention even when the maximum total output $QP_{max}$ of the pumps is not high enough, the subject of the invention is also a radial-type electrogalvanizing cell having soluble anodes which includes means for moving a metal strip successively past said anodes, means for passing an electric current between said strip and said anodes and means for making the plating solution flow through the gap separating the anodes from the moving strip, said anodes being separated in the direction of movement of the strip by narrow windows, which also includes electrically insulating means for blocking off said windows.

According to the invention, there therefore now exists only a single injection rail per cell, arranged at the last anode on the side where the exiting strip emerges from the plating solution and fed by the total output Qp of the pumps.

This arrangement of the cell, which is characteristic of the invention, enables the maximum speed of flow of the solution to be substantially increased. This new maximum is termed $V'g_{max}$.

By virtue of the invention, the straight line $J_{lim.max}=A\times V'g_{max}+A\times f(e)\times J$, which limits the range of deposition conditions, is therefore shifted to higher values of $J_{lim}$, thereby extending said range and making it easier to operate the process according to the invention in conventional industrial plants, especially without modifying the maximum output characteristics of the pumps feeding the injection rails.

The new range, extended by the invention, is represented by the combination of the hatched area and a "dotted" area in FIG. 2, using the same conventions as previously.

According to the invention, said blocking-off means preferably consist of plastic panels.

According to the invention, said means for making the solution flow preferably consist of a multitube injection rail arranged at the last anode on the side where the exiting strip emerges from the solution, of the type including a feed pipe arranged transversely to the path along which the strip moves, said pipe opening into a plurality of parallel tubes terminating in ejection nozzles immersed in said solution beneath its free surface and in the gap separating said strip from said anode.

This type of multitube injection rail is especially described in document FR 2,607,153 as the means for making the plating solution flow at a predetermined speed Vg as a counterflow to the movement of the strip.

According to this document, this type of injector is particularly adapted to conditions for electrogalvanizing at a high speed of flow Vg of the solution and takes the form of an injection rail arranged transversely to the path along which the strip moves in the cell and along an anode rim in order to inject plating solution into the gap separating said anode from a moving strip.

This injection rail includes a feed pipe which opens into a plurality of tubes passing through the partition in said pipe.

The tubes of this rail are mutually parallel and approximately equidistant, dip into the plating solution beneath its free surface and form, at their end, nozzles for injecting the solution in the opposite direction to that of the movement of the strip, that is to say as a counterflow.

These multitube injection rails are distinguished from other injection rails commonly used which only have a single injection nozzle in the form of a narrow slit extending over the entire width of the strip.

As indicated in the already mentioned document FR 2,607,153, these multitube injection rails have the advantage of reducing the risks of air-bubble entrainment in the solution because of the partial vacuum which is created at the ejectors, which risks increase when high speeds Vg of flow of the solution are used.

BRIEF DESCRIPTION OF THE DRAWINGS

The invention will be better understood on reading the following description, given by way of example, with reference to the appended figures in which.

DESCRIPTION OF THE PREFERRED EMBODIMENTS

Figure 1:
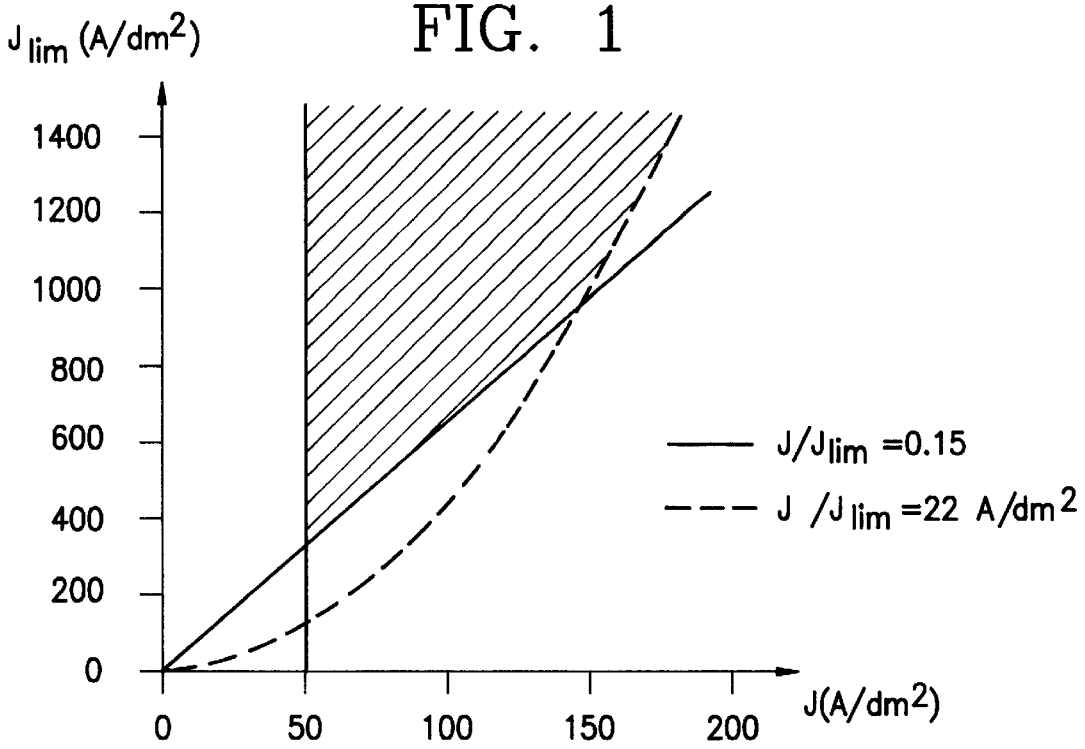
FIG. 1 shows, in the hatched area, the range of deposition conditions according to the invention in the current density (J) v limiting current density ($J_{lim}$) diagram.
Figure 2:
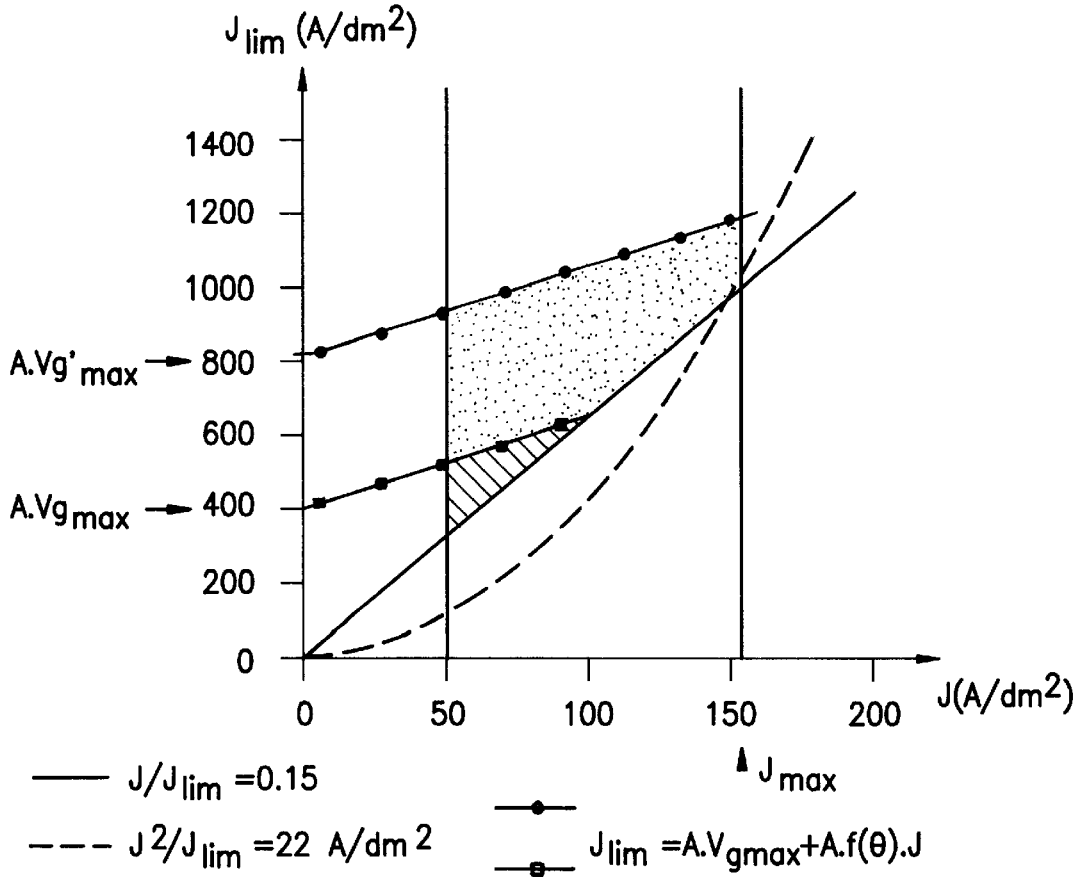
FIG. 2 shows two ranges of deposition conditions using the same presentation as in FIG. 1, but taking into account the operating limits of the electrogalvanizing plant, in two different configurations of the means for injecting electrolyte as a counterflow.

The electrogalvanizing cell is of the radial type.

Conventionally, it comprises a tank containing the plating solution, a drum half-immersed in the solution and rotating freely about its horizontal axis.

Movement means, not shown, enable a metal strip to be moved conventionally over the drum in the tank.

Typically, the speed of movement Vd may be between 60 and 200 m/min.

Facing the drum, at its bottom part, are two curved soluble-anode panels; the two anode panels are symmetrical with respect to a vertical plane passing through the axis of the drum and are each arranged in the same way about the drum, separated from the latter by an approximately constant distance.

The average distance separating the anode panels from a strip moving over the drum is generally between 20 and 60 mm.

The product of this average distance separating the drum from the anode panels multiplied by the width of the drum is termed Sg, which thus represents the average flow cross section of the solution between the anode panels and the strip.

Typically, for a drum 2 m in width, for an average anode/strip separation of 45 mm, the average flow cross section Sg of the solution is 9 $dm^2$.

Toward the base of the drum, the two anode panels are separated by a narrow window which extends over the width of the drum.

Conventionally, the electroplating cell comprises means for passing an electric current between the moving strip and the anode panels, these means being capable of delivering a given maximum current $I_{max}$.

Conventionally, the electroplating cell also comprises means for making the plating solution flow between the gap separating the anode panels from the strip in the opposite direction to that of the movement of the strip.

These means for making the solution flow comprise two injection rails, one arranged at the bottom of the tank in order to inject solution into the narrow window separating the two anode panels and the other arranged near the free surface of the solution along the rim of a group of anodes on the side where the moving strip emerges from the solution.

The two injection rails are fed by pumps capable of delivering a maximum total output $QP_{max}$.

In a manner known per se, from the values of $QP_{max}$ and of the average flow cross section Sg, and by taking into account the ejection performance capabilities of the injection rails, the maximum speed of flow of the solution $Vg_{max}$ in counterflow to the movement of the strip is derived therefrom.

Typically, the solution flow rate Qg in the gap separating the anode panels from the strip may be adjusted between 6 and 10 $m^3$/min.

The solution flow rate Qg and the speed of flow of the solution Vg are related by the equation: $Qg=Vg\times Sg$.

Thus, for an average flow cross section Sg=9 $dm^2$, the maximum speed of flow of the solution $Vg_{max}$ equals 111 m/min.

The plating solution contains zinc cations in a chloride-based anionic medium and possibly other conventional additives, such as grain refiners.

In order to reach sufficiently high deposition rates, the concentration of zinc cations is preferably greater than 1.6 mol/liter and the concentration of chloride anions is preferably greater than 8.5 mol/liter.

Preferably, the temperature of the plating solution is between 57° and 65° C.

A sample of the electrogalvanizing solution is removed in order to determine experimentally the value of the constant A necessary for the calculation of $J_{lim}$ according to the equation $J_{lim}=A\times V$, where V is the average speed of flow of the electrolyte between the moving strip and the anode panels.

The factor A is determined using the method, known per se and described previously, called the "Levich line" method, based on a series of tests in a laboratory rotating-metal-disk cell containing the sample of solution.

If ω is the speed of rotation of the disk and $J'_{lim}$ is the result of the measurement of the limiting density, a series of pairs of values ($J'_{lim}$, ω) is thus obtained experimentally which make it possible to determine the constant k which relates $J'_{lim}$ to ω according to the equation, known elsewhere, $J'_{lim}=k\times\sqrt{\omega}$.

A is then calculated using the equation A=k/k', where k' equals 2.97 m/(min.)$^{0.5}$ if the rotating disk of the laboratory cell has a surface area of 0.1 $cm^2$.

Without departing from the present invention, other methods of determining the factor A may be used.

Preferably, the strip to be coated is made of steel.

Typically, the metal strip to be coated has a width or "format" Lb of between 1 and 2 m.

Taking into account the degree of filling of the cell with plating solution, the length Lc of the immersed part of the moving strip opposite the anode panels is known.

From the maximum value $I_{max}$ of the electric current in the cell, from the format of the strip Lb and from the immersed length Lc, the maximum current density $J_{max}$ is derived using the equation: $J_{max}=I_{max}/(Lb\times Lc)$.

Typically, the current density J may be adjusted between 50 and 150 A/$dm^2$.

The lower limit of 50 A/$dm^2$ corresponds to the currently accepted limit below which it is considered that the deposition conditions are no longer industrially acceptable, that is to say sufficiently economic.

Moreover, in order to determine the function f(e) for the zinc deposit thickness e, which relates the speed of movement of the strip Vd to the current density J according to the equation Vd=f(e)×J, the mass of zinc deposited $M_{Zn}$ may be expressed in two different ways which are known per se:

on the one hand, as a function of the volume of the deposit and of the density $\rho_{Zn}$ of the zinc: $M_{Zn}=\rho_{Zn}\times Lb\times Lc\times e$; and on the other hand, as a function of the number of moles $N_{Zn}$ of zinc ions which are reduced and therefore deposited onto the strip, taking into account an electrolysis efficiency R:

$N_{Zn}=R\times 1/(2F)\times J\times(Lb\times Lc)\times(Lc/Vd)$, where F is Faraday's constant.

If $U_{Zn}$ is the molecular mass of zinc, then $M_{Zn}=N_{Zn}\times U_{Zn}$.

From this is derived the relationship between Vd and J, and therefore the expression for f(e):

$$f(e)=R/(2F)\times U_{Zn}/\rho_{Zn}\times Lc/e.$$

Thus, assuming an efficiency R of 94%, and expressing e in micrometers, Lc in meters, Vd in meters/minute and J in amps/dm$^2$, then:

$$Vd=(0.266\ Lc/e)\times J \text{ or } f(e)=0.266\ Lc/e.$$

Next, on a diagram depicting J as abscissa and $J_{lim}$ as ordinate, the following curves or straight lines are plotted:

$J/J_{lim}=0.15$ $J^2/J_{lim}=22$ A/dm$^2$ $$J_{lim}=A\times Vg_{max}+A\times f(e)\times J$$

$J=J_{max}$ $J=50$ A/dm$^2$.

Next, the range of deposition conditions according to the invention are defined:

$J/J_{lim}<0.15$ $J^2/J_{lim}<22$ A/dm$^2$ $$J_{lim}<A\times Vg_{max}+A\times f(f)\times J$$

$J<J_{max}$ $J>50$ A/dm$^2$.

From several profilometry readings on the metal strip, the initial average arithmetic rugosity Ra° of the face to be coated is measured; the arithmetic rugosity is defined in the preamble to the present application.

Next, according to the invention, the deposition conditions are chosen to be within said previously defined range.

When the electroplating cell forms part of an industrial line which includes several successive cells, it may be advantageous to carry out the process according to the invention only in the end cells of the industrial line, ie. the most downstream and/or the most upstream in the direction of movement of the strip.

The process according to the invention often amounts to determining the value of a single parameter, either the speed of flow of the solution Vg or the solution flow rate Qg in the strip/anode gap, in such a way that the deposition conditions lie within the range according to the invention.

In a manner known per se, which takes into account the particular geometry of the solution injection rails in the cell, the injection rails are fed, in order to achieve the defined value of said parameter Vg or Qg, especially by adjusting the output Qp of the pumps feeding both injection rails at the same time.

Preferably, conditions are chosen, from those within the range according to the invention, which correspond to values of the highest possible current density J in order to obtain a high rate of deposition and to optimize the running of the cell.

Next, the metal strip is electrogalvanized according to these predetermined deposition conditions according to the invention.

A metal strip is obtained which is coated with a layer of zinc with the desired thickness e.

Next, the average arithmetic rugosity Ra' of the coated face of the strip is measured and the rugosity increment ΔRa=R'−Ra° is derived therefrom.

It is observed that, even though the electroplating cell is used to the best of its performance capabilities, especially in terms of speed of movement Vd and/or current density J, the rugosity increment remains less than 0.25 microns.

It is also observed that there are no or virtually no edge dendrites on the strip coated according to the invention.

The process according to the invention gives the same results as regards the low rugosity increment and absence of dendrites for other deposition conditions whenever they fall within the range according to the invention or whatever the desired deposit thickness.

The invention also applies to electroplated coatings of low-alloy zinc, especially one containing nickel.

According to one advantageous variant of the invention, it is possible to extend the range of deposition conditions according to the invention by modifying the electrogalvanizing cell in the following way.

According to the invention, the means for making the solution flow comprise just a single injection rail arranged as previously along the rim of an anode panel on the side where the moving strip emerges from the solution.

Preferably, this injection rail includes a feed pipe arranged transversely to the path along which the strip moves and a plurality of parallel tubes emerging from the pipe and terminating in ejection nozzles immersed in the solution beneath its free surface and in the gap separating the strip from the rim of the anode panel.

In a manner known per se, the ejection rail is constructed and installed in such a way that the sum of the ejection cross sections of the nozzles, or ejecting cross section Se, is adapted to the solution flow cross section Sg between the strip and the groups of anodes.

Advantageously, this configuration of the injection rail makes it possible to entrain the plating solution surrounding the nozzles under the effect of the forced ejection of solution by the nozzles themselves.

As a result, the solution flow rate Qg between the strip and the anode panels is greatly superior to the total output of solution ejected by the nozzles Qe.

As there is now just a single injection rail, the total output ejected by the nozzles Qe is equivalent to the output delivered by the pumps Qp.

Also according to the invention, in this cell the narrow window, which separates the two groups of anodes, is blocked off by an insulating panel, preferably made of plastic.

This panel may especially be made of polypropylene.

By virtue of the modified cell according to the invention, which now only has a single injection rail, the output of the pumps is concentrated onto a single injection rail and it is then observed that it is possible to reach a solution flow rate or a speed of flow of the solution Vg' between the strip and the anode panels which is very much greater than that obtained previously.

Thus, the maximum speed of flow of the solution $V'g_{max}>Vg_{max}$.

The straight line $J_{lim}=A\times Vg_{max}+A\times f(e)\times J$, which represents a limit of the range according to the invention, is therefore shifted and the range according to the invention is extended.

In this cell according to the invention, since the anode "bed" is continuous by virtue of the insulating panel which blocks off the window between the two groups of anodes, the speed of flow of the solution Vg remains sufficiently uniform within the entire strip/anode gap in the direction of movement of the strip.

By virtue of the modified cell according to the invention, it is very much easier to meet the deposition conditions corresponding to the thus-enlarged range according to the invention, and thus very much easier to obtain the result of having low rugosity and no edge dendrites, even through the process is carried out at high current densities J.

Of course, in an electroplating cell having more than two anode panels distributed along the path in which the strip moves, which would therefore have several narrow windows separating the groups of anodes, according to the invention, as previously only a single injection rail is arranged and all the narrow windows are blocked off by insulating panels in order to make the anode "bed" continuous.

Finally, it is also possible to operate the process according to the invention in types of cells other than radial cells.

The following examples illustrate the invention.

EXAMPLE 1

The object of this example is to illustrate the variation in the rugosity increment of a surface after coating as a function of the factor $J/J_{lim}$ for a constant speed of flow of the solution between the surface to be coated and an anode which faces it.

Using a cell of the rotating-electrode type, a series of zinc electroplating tests were therefore carried out in a chloride-based plating solution on identical steel disks rotating above a soluble anode at a constant speed of 1000 revolutions/minute and by varying the plating current density J from 30 to 130 A/dm$^2$.

The diameter of the steel disks was 10 mm.

The plating solution contained 2 mol/liter of $Zn^{2+}$ ions and 8.5 mol/l of $Cl^-$ ions.

During deposition, the temperature of the solution was approximately 60° C.

While operating at a constant speed of 1000 revolutions/minute, the limiting current density $J_{lim}$ was measured, by locating the position of the current-density plateau on the "current v potential" curve, as described previously.

Thus, a value of $J_{lim}$=314 A/dm$^2$ was derived.

Before coating, the average arithmetic rugosity of the surface of the steel disks was measured, this generally being between 0.8 and 1.3 microns.

All the tests in the series were carried out in the same cell and under the same conditions of substrate nature and of the solution nature, concentration and temperature, in order to obtain a coating 10 microns in thickness.

After coating, the rugosity of the coated face of the series of disks obtained was measured and the rugosity increment, in this case ΔRa, was calculated for each disk by subtracting the rugosity measured before the test.

The following results were obtained:

| J (A/dm$^2$) | $J/J_{lim}$ | ΔRa (μ) |
|---|---|---|
| 31.4 | 0.1 | 0.20 |
| 62.9 | 0.2 | 0.32 |
| 94.3 | 0.3 | 0.40 |
| 125.7 | 0.4 | 0.50 |

Figure 3:
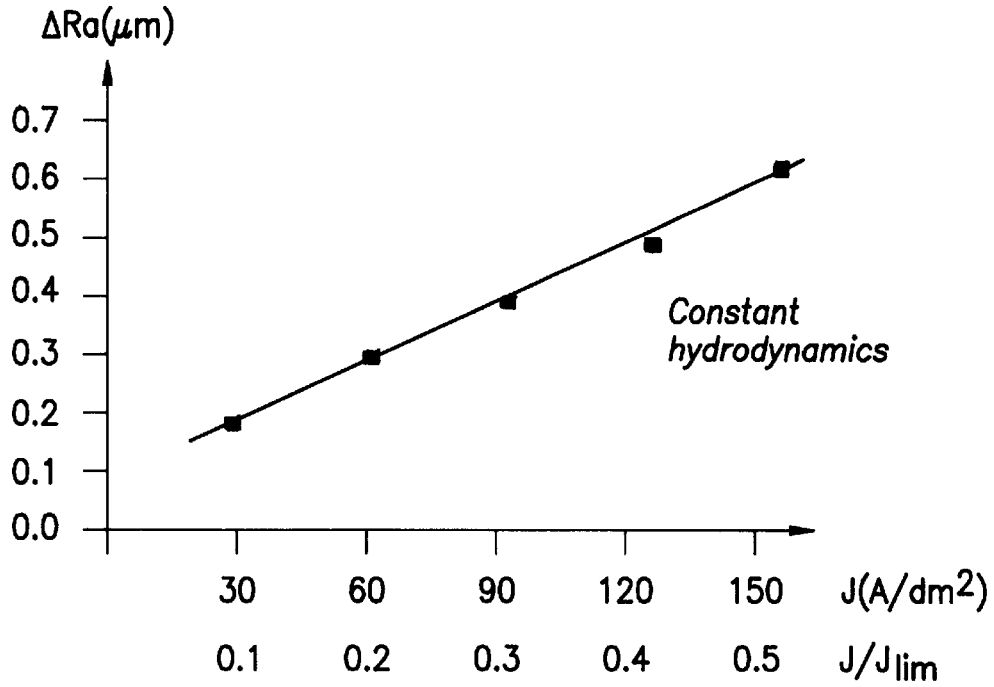
FIG. 3 corresponds to Example 1 and shows the variation in the rugosity increment of a substrate after a deposition of zinc, as a function of the ratio $J/J_{lim}$ or of the current density J, under constant hydrodynamic conditions, corresponding to the speed of flow of the electrolyte with respect to the substrate in a rotating-electrode cell.

The results obtained are plotted in FIG. 3.

It may be observed that, in order to reach a low rugosity increment, especially one less than 0.25 microns, it is necessary to operate with a current density J such that $J/J_{lim}$ is less than or equal to 0.15.

EXAMPLE 2

The object of this example is to illustrate the variation in the rugosity increment of a surface after coating as a function of the factor $J/J_{lim}$ with a constant current density.

Using the same type of cell as in Example 1, a second series of zinc electroplating tests was carried out on the same steel disks and in the same plating solution as in Example 1, with a constant current density of 75 A/dm$^2$ and by varying the speed of rotation ω of the disk between 300 and 5000 revolutions/minute.

For the various speeds of rotation of the disk in the second series of tests, the limiting current density $J_{lim}$ was measured by identifying the position of the current-density plateau in the "current v potential" curve, as described previously.

Before coating, the surface of the steel disks had an average arithmetic rugosity of between 0.8 and 1.3 microns.

All the tests in the series were carried out under identical conditions apart from the speed of rotation of the disks in order to obtain a coating 10 microns in thickness.

After coating, the rugosity of the coated surface was measured for the various disks and the rugosity increment ΔRa of each disk was calculated by subtracting the measured rugosity before the test.

The following results were obtained:

| ω(revolutions/min) | $J_{lim}$ (A/dm$^2$) | $J/J_{lim}$ | ΔRa (μm) |
|---|---|---|---|
| 5000 | 750 | 0.1 | 0.15 |
| 1316 | 375 | 0.2 | 0.27 |
| 605 | 250 | 0.3 | 0.39 |
| 363 | 187 | 0.4 | 0.46 |

Figure 4:
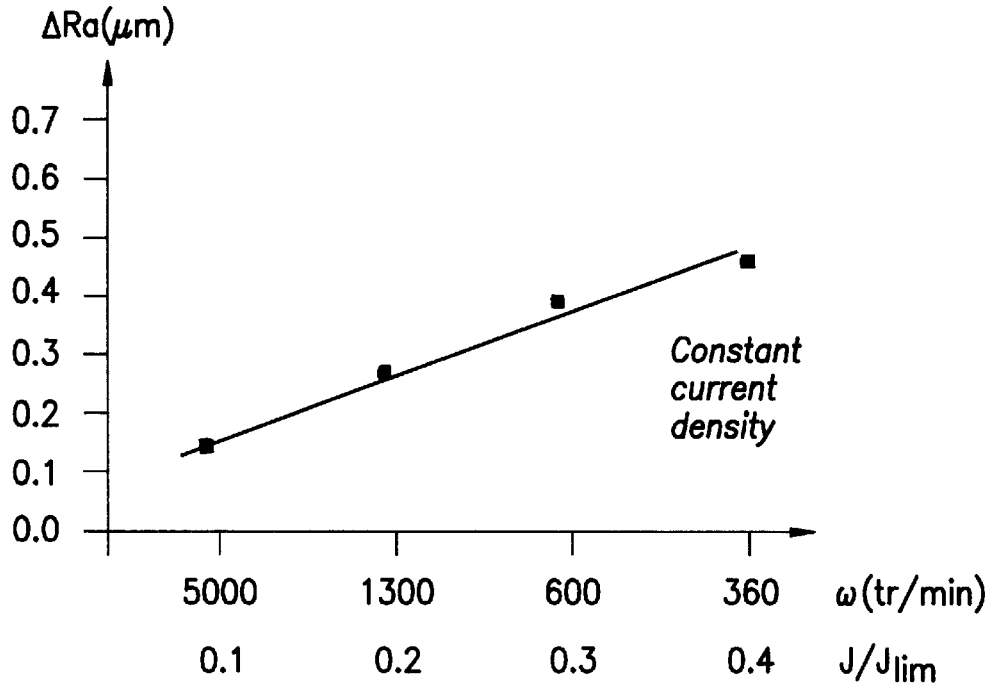
FIG. 4 corresponds to Example 2 and shows the variation in the rugosity increment as a function of the ratio $J/J_{lim}$, under varying hydrodynamic conditions, corresponding to the various speeds of rotation ω of the rotating electrode of the cell, the current density J being constant.

The results are plotted in FIG. 4, which illustrates the relationship between ΔRa and the ratio $J/J_{lim}$ when J is constant.

It may be observed that, in order to reach a low rugosity increment, especially one less than 0.25 microns, it is necessary to operate with a speed of flow of the electrolyte in the vicinity of the surface to be coated such that $J/J_{lim}$ is less than or equal to 0.15.

EXAMPLE 3

The object of this example is also to illustrate the variation in the rugosity increment of a surface after electrogalvanizing a surface in two steps:

a first step corresponding to a deposit 8 micrometers in thickness, under conditions such that $J/J_{lim}$=0.3, that is to say outside the range according to the invention; and a second step corresponding to a second deposit 2 micrometers in thickness, under conditions such that $J/J_{lim}<0.3$, at a constant current density and by varying the speed of flow of the solution in the vicinity of the surface to be coated.

Using the same type of cell as in Example 1, a third series of zinc electroplating tests was therefore carried out according to these two steps on the same steel disks and in the same plating solution as in Example 1.

For the second step, the speed of rotation ω of the disk was between 300 and 5000 revolutions/minute.

For the various speeds of rotation of the disk in the second step, the limiting current density $J_{lim}$ was measured by identifying the position of the current-density plateau in the "current v potential" curve, as described previously.

Before the first zinc-coating step, the surface of the steel disks had an average arithmetic rugosity of between 0.8 and 1.3 microns.

After the two coating steps, the rugosity of the coated surface of the various disks was measured and the rugosity increment ΔRa of each disk was calculated by subtracting the measured rugosity before the test.

The following results were obtained:

| ω(revolutions/min) | $J/J_{lim}$ | ΔRa (μm) |
|---|---|---|
| 8000 | 0.12 | 0.19 |
| 4822 | 0.15 | 0.22 |
| 3127 | 0.20 | 0.30 |
| 363 | 0.27 | 0.41 |

Figure 5:
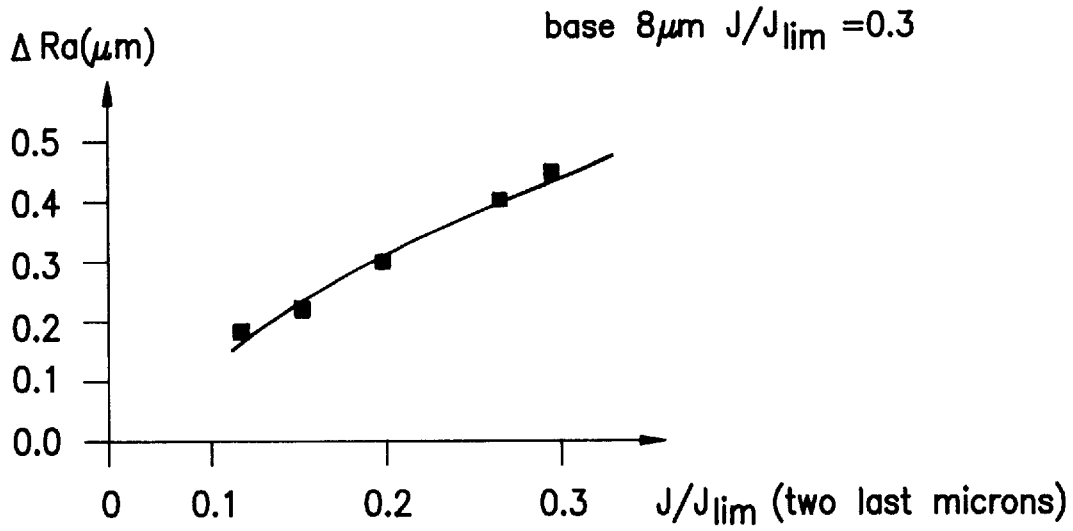
FIG. 5 corresponds to Example 3 and shows the variation in the rugosity increment as a function of the ratio $J/J_{lim}$ following a coating of zinc produced in two steps, the first step using identical conditions and the second step using variable conditions characterized by the ratio $J/J_{lim}$.

The curve in FIG. 5 illustrates the relationship between ΔRa and the ratio $J/J_{lim}$ which relates only to the second deposition step.

It may thus be observed that it is essential to carry out the process under the conditions of the invention for the finishing of the deposition, and it may be deduced from this that, in an industrial electrogalvanizing plant having many successive cells, it is advantageous to carry out the deposition according to the invention in the end cells of the plant, especially the last ones.

Thus, even if the zinc deposition has been started under conditions different from those of the invention, in this case with a ratio $J/J_{lim}=0.3$, and which would lead to a large rugosity increment, it is still possible to "compensate" for this rugosity increment defect by a deposition "finish", in this case on a thickness of 2 micrometers, under the deposition conditions of the invention.

EXAMPLE 4

The object of this example is to illustrate the variations in the rugosity increment as a function of the thickness of the deposit produced, on the one hand when the coating according to the invention is carried out under conditions such that $J/J_{lim}=0.1$, and on the other hand when the coating is carried out under conditions different from those of the invention, that is to say conditions such that $J/J_{lim}=0.3$.

In the same type of cell and the same plating solution as in Example 1, two series of corresponding electrogalvanizing tests were therefore carried out, the first under conditions such that $J/J_{lim}=0.1$ and the second under conditions such that $J/J_{lim}=0.3$, while at the same time varying the thickness of deposition, that is to say its duration.

As in the previous examples, the rugosity increment ΔRa was determined.

The following results were obtained:

| Thickness (μm) | 1st series : $J/J_{lim}$ = 0.1 ΔRa (μm) | 2nd series : $J/J_{lim}$ = 0.3 ΔRa (μm) |
|---|---|---|
| 1 | 0.0 | 0.17 |
| 2 | −0.03 | 0.12 |
| 3 | 0.0 | 0.14 |
| 5 | 0.07 | 0.23 |
| 7 | 0.12 | 0.29 |
| 10 | 0.17 | 0.39 |

Figure 6:
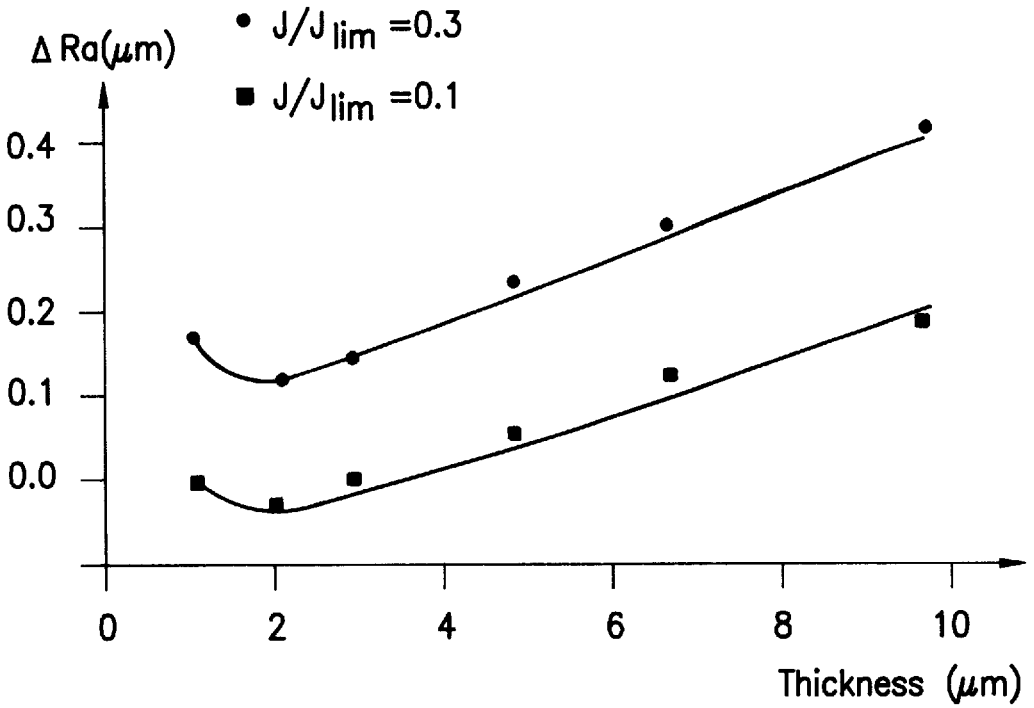
FIG. 6 corresponds to Example 4 and shows the variation in the rugosity increment for various deposit thicknesses, produced using two series of deposition conditions characterized by the ratio $J/J_{lim}$.

The curves in FIG. 6 illustrate the relationship between ΔRa and the thickness of the deposit for the two values of $J/J_{lim}$.

Two areas of deposit thickness may be observed:

an area of small thickness, less than 3 μm, for which the rugosity increment depends strongly on the ratio $J/J_{lim}$ but not very much on the thickness deposited;

an area of greater thickness, greater than 3 μm, for which, on the contrary, the rugosity increment depends strongly on the thickness deposited but not very much on the ratio $J/J_{lim}$.

This behavior of the rugosity increment with the thickness of the deposit produced and with the ratio $J/J_{lim}$ confirms the advantage of operating under the conditions of the invention primarily at the start and/or the end of deposition, that is to say in the end cells of an electrogalvanizing plant.

EXAMPLE 5

The object of this example is to illustrate the variation in the microstructure of the edge dendrites as a function of the factor $J^2/J_{lim}$.

The dendrites which form at the edges of a strip during deposition treatment may exhibit poor adhesion to the substrate; this poor adhesion arises from a very coarse and irregular microstructure; the dendrites having poor adhesion are particularly troublesome because they run the risk of becoming detached during treatment of the strip and then run the risk of subsequently fouling the strip itself or the electroplating plant.

Under conditions comparable to those in Examples 1 and 2, three series of zinc deposits of 10 microns in thickness were produced on steel substrates corresponding to values of the ratio $J^2/J_{lim}$ of 22, 40, 60 $A/dm^2$, respectively.

Next, micrographs of edge sections of these coatings were produced with a magnification of the order of 10.

Figure 7:
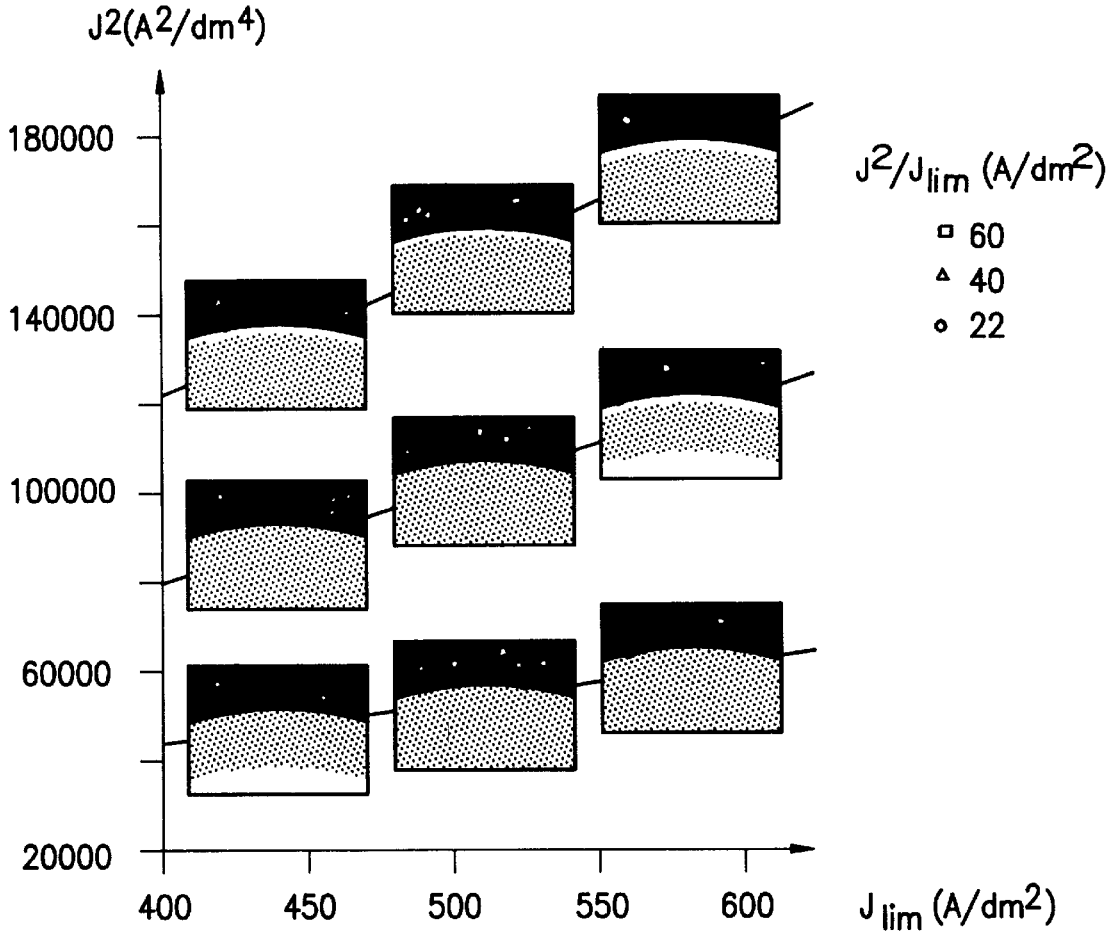
FIG. 7 corresponds to Example 5 and shows, in a limiting current density ($J_{lim}$) v current density squared ($J^2$) diagram, the microstructure of the zinc deposit at the edge for three series of deposition conditions, characterized by the ratio $J^2/J_{lim}$.

As shown in FIG. 7, these micrographs were then plotted on a diagram having $J_{lim}$ as abscissa and $J^2$ as ordinate.

It may be observed that, within each series thus defined, the dendrites all have the same apparent microstructure, confirming the relevance of the $J^2/J_{lim}$ criterion adopted according to the invention.

According to the invention, when $J^2/J_{lim}$ is less than or equal to 22 $A/dm^2$, edge dendrites are greatly limited and are virtually absent.

EXAMPLE 6

The object of this example is to illustrate the variation in the amount of edge dendrites as a function of $J^2/J_{lim}$.

Zinc deposits 10 micrometers in thickness were produced under various deposition conditions corresponding to values of $J^2/J_{lim}$ lying between 14 $A/dm^2$ and 56 $A/dm^2$.

For each of the tests, the charge of edge-deposited zinc of the various specimens with respect to the length of edge was measured.

It may be estimated that a charge of zinc of approximately 150 mg/m is normal for a deposit 10 micrometers in thickness and corresponds to the absence of dendrites.

Figure 8:
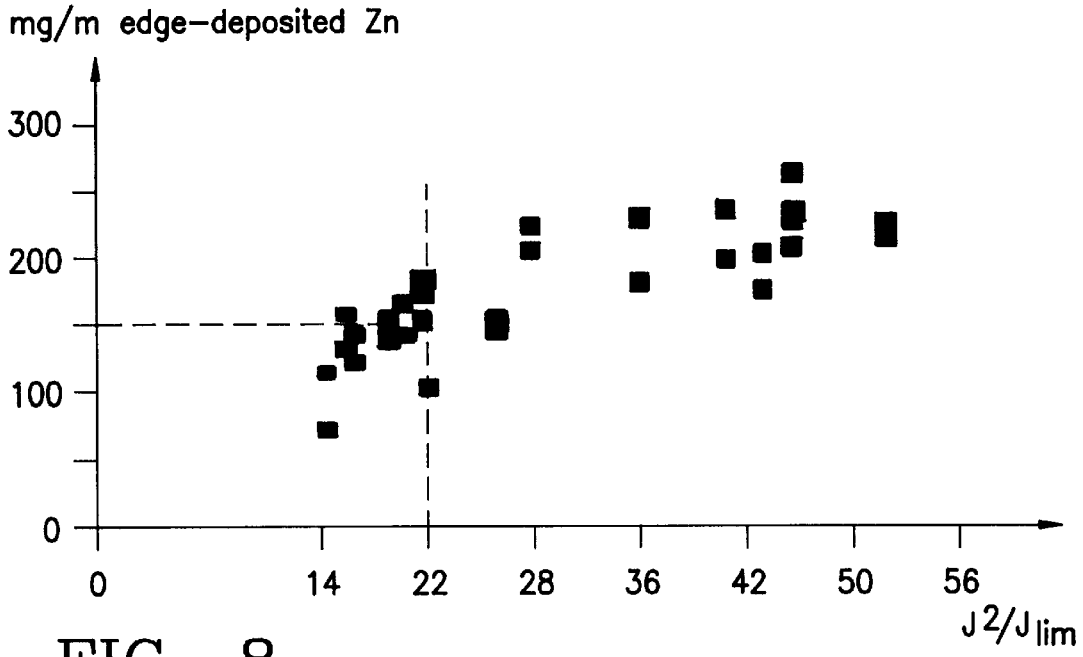
FIG. 8 corresponds to Example 6 and shows the charge of zinc deposit at the edge for various deposition conditions, characterized by the ratio $J^2/J_{lim}$.

Next, as indicated in FIG. 8, the measurements of linear charge of edge-deposited zinc as ordinate were plotted as a function of the $J^2/J_{lim}$ value, plotted as abscissa, corresponding to the deposition conditions of the various tests.

According to the invention, it may be observed that if the deposition is carried out under conditions such that $J^2/J_{lim}$ is less than or equal to 22 A/dm$^2$, the charge of edge-deposited zinc decreases to the normal level of approximately 150 mg/m, that is to say the average charge of zinc in the coating remote from the edges.

A zinc coating is thus obtained which is much more uniform in terms of thickness, having no additional thickness at the edges.

EXAMPLE 7

It was endeavored to coat a steel strip of width Lb=1.5 m with a layer of zinc having a thickness of e=15 micrometers in a plant comprising conventional radial cells each provided with two anode panels, the anodes being separated by a narrow window and each provided with two counterflow electrolyte injection rails fed by pumps, one of which rails is at the bottom of the cell.

The plating solution contained 4.5 mol/liter of KCl and 2 mol/liter of $ZnCl_2$.

The total immersed length Lc of strip opposite the anodes in the plant was equal to Lc=36 m.

The maximum speed $Vg_{max}$ of flow of the solution allowed by the two injection rails of each cell was 90 m/min.

As indicated previously, the factor A relating $J_{lim}$ (expressed in A/dm$^2$) to the strip/electrolyte relative speed V (expressed in m/min) according to the equation $J_{lim}=A\times V$ was determined experimentally. The result A=3.58 was found.

The total immersed length Lc of strip opposite the anodes and the maximum current $I_{max}$ of the electrical supply of the cells made it possible to obtain a maximum current density $J_{max}$ of 111 A/dm$^2$.

As indicated previously, assuming an electroplating efficiency R of 94%, expressing the thickness e in micrometers, Lc in meters, the speed of movement Vd of the strip in meters/minute and the current density J in amps/dm$^2$, Vd=f(e)×J, where f(e)=0.266 Lc/e, or f(e) =9.576/e, and, for e=15 μm, f(e) equals 0.639.

Figure 9:
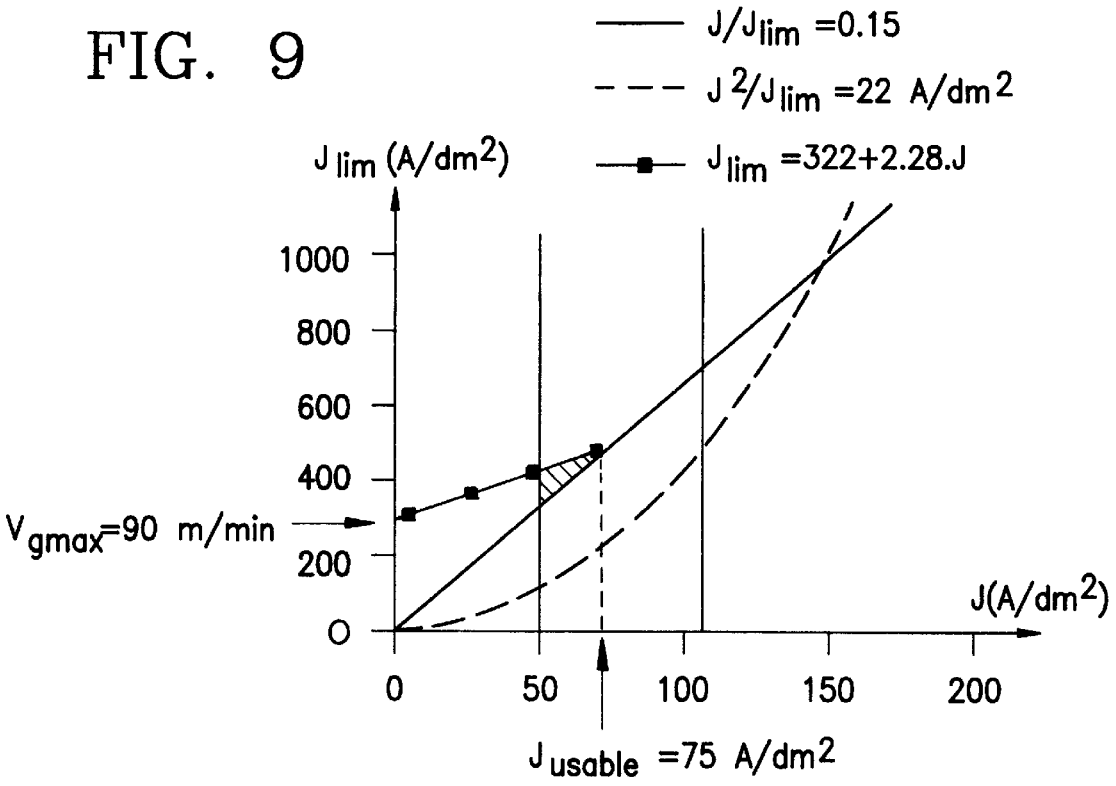
FIG. 9 depicts the range (hatched area) of deposition conditions according to the invention corresponding to Example 7, in an industrial electrogalvanizing plant, shown in the current density (J) v limiting current density ($J_{lim}$) diagram.

Next, as indicated in FIG. 9, the following curves or straight lines were plotted on a diagram depicting J as abscissa and $J_{lim}$ as ordinate:

$J/J_{lim}=0.15$ $J^2/J_{lim}=22$ A/dm$^2$ $J_{lim}=A\times Vg_{max}+A\times f(e)\times J$, i.e. $J_{lim}=322+2.3$ J $J=J_{max}=111$ A/dm$^2$ J=50 A/dm$^2$.

The range of deposition conditions according to the invention was then defined as follows, and turns out to be very restricted, as indicated by the hatched area in FIG. 9:

$J/J_{lim}<0.15$ $J^2/J_{lim}<22$ A/dm$^2$ $J_{lim}<322+2.3$ J (expressed in A/dm$^2$)

50 A/dm$^2$<J<111 A/dm$^2$.

From several profilometer readings on the metal strip, the initial average arithmetic rugosity Ra° of the face to be coated was measured.

Next, according to the invention, the deposition conditions were chosen to be within said range defined previously.

Said deposition conditions especially comprised, in addition to the current density J, the speed of movement Vd and the speed of flow of the electrolyte Vg, which determine the relative speed V=Vd+Vg, and the limiting current density $J_{lim}=A\times V=3.58$ V.

Next, the metal strip was electrogalvanized according to these predetermined deposition conditions according to the invention and a metal strip coated with a zinc layer of thickness e=15 μm was obtained.

Next, the average arithmetic rugosity Ra' of the coated face of the strip was measured and the rugosity increment ΔRa=Ra'−Ra° was derived therefrom.

It was observed that the rugosity ΔRa remained less than 0.25 microns.

It was also observed that there were no edge dendrites on the coated strip.

Unfortunately, it was not possible in this case for the electrical plant supplying the cells to be run at maximum output without running the risk of there being edge dendrites and/or too high a rugosity increment.

In fact, for J=111 A/dm$^2$ (the maximum), the conditions $J_{lim}<322+2.3J$, i.e. $J_{lim}<577$ A/dm$^2$, and $J/J_{lim}<0.15$, i.e. $J_{lim}>740$ A/dm$^2$, must both apply, which is impossible.

EXAMPLE 8

The object of this example is to illustrate that the conditions of the invention can be achieved more easily by using a radial cell which is provided with only a single injection rail and which has a continuous anode "bed".

In each radial cell in Example 7, while keeping the same feed pumps, the injection rail of the bottom of the cell was removed and the narrow window obstructed by an insulating panel between the two anode panels.

Each cell thus modified only had a single injection rail and a continuous anode "bed".

Using the electrogalvanizing plant thus modified, attempts were made to produce, on the same steel sheet, a zinc coating of the same thickness, limiting as previously the rugosity index but at higher current densities or speeds.

The parameters characterizing the strip to be coated, the thickness of the deposit, the cells and the solution were the same as in Example 7, apart from the maximum speed $Vg_{max}$ of flow of the solution which was increased to 180 m/min because of the connection of the pumps to a single injection rail per cell and because of the continuous anode bed.

Figure 10:
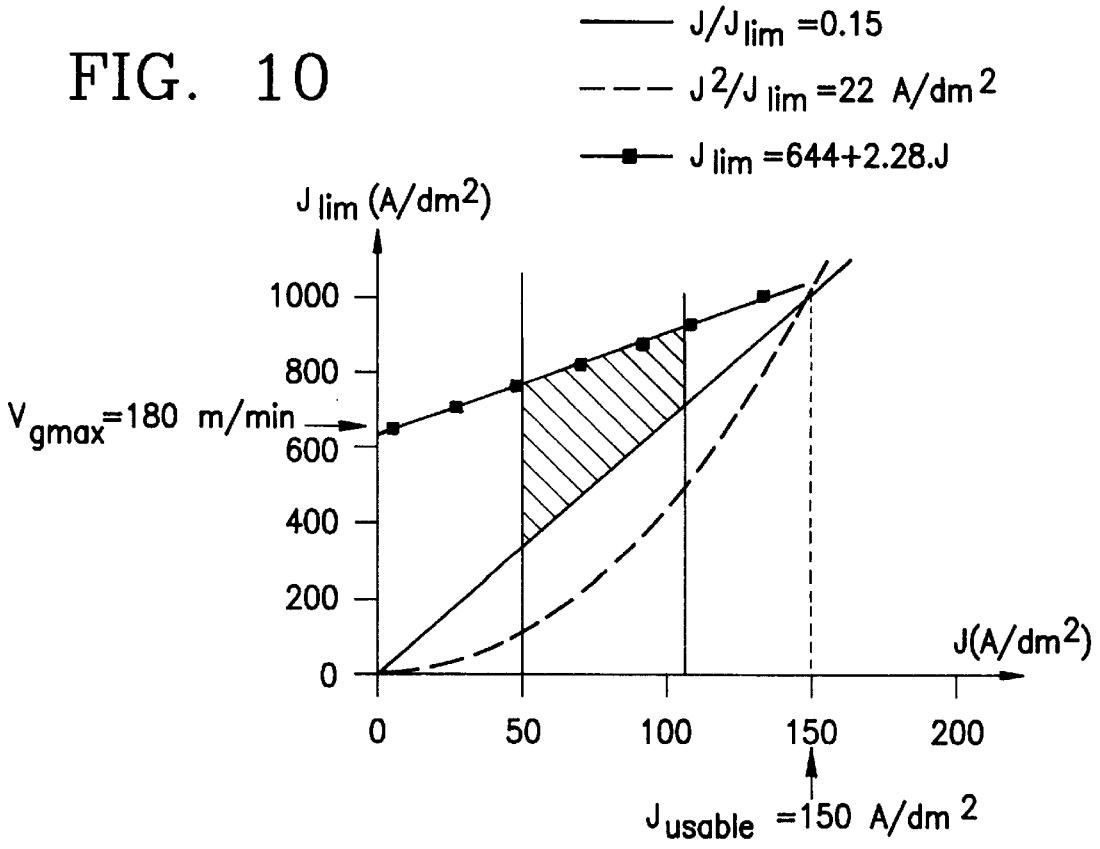
FIG. 10 depicts an enlarged range (hatched area) of deposition conditions corresponding to Example 8, when, according to the invention, the double-rail electrolyte injection means are replaced by single-rail injection means in the cells of the plant.

As indicated in FIG. 10, the following curves or straight lines were then plotted as previously:

$J/J_{lim}=0.15$ $J^2/J_{lim}=22$ A/dm$^2$ $J_{lim}=A\times Vg_{max}+A\times f(e)\times J$, i.e. $J_{lim}=644+2.3$ J $J=J_{max}=111$ A/dm$^2$ J=50 A/dm$^2$.

The range of deposition conditions according to the invention was more extended than in Example 7 (see the hatched area in FIG. 10) and is thus defined as follows:

$J/J_{lim}<0.15$ $J^2/J_{lim}<22$ A/dm$^2$ $J_{lim}<644+2.3$ J (expressed in A/dm$^2$)

50 A/dm$^2$<J<111 A/dm$^2$.

It thus becomes possible to produce deposits with higher values than in Example 7 of the current density J, the speed of movement Vd and the speed of flow of the electrolyte Vg, without correspondingly running the risk of a rugosity increment greater than 0.25 $\mu$m and/or the appearance of edge dendrites.

It becomes possible, in particular in this case, to run the electrical installation supplying the cells at their maximum output, without running the risk of there being edge dendrites and/or too high a rugosity increment.

In fact, for J=111 A/dm$^2$ (the maximum), the conditions $J_{lim}<644+2.3J$, i.e. $J_{lim}<900$ A/dm$^2$ and $J/J_{lim}<0.15$, i.e. $J_{lim}>740$ A/dm$^2$, may both be met.

Thus, when one is limited by the pump outputs to achieve strip/electrolyte relative speeds V and thus to lower the factor $J/J_{lim}$ below 0.15, while maintaining high values of current density, it is advantageous to use plants provided with cells according to the invention which are modified in this way.

What is claimed is:

1. A continuous process for the electrogalvanizing of a metal strip in a chloride-based plating solution, in which said strip is moved past an anode, said solution is made to flow at a speed V through the gap separating said strip from said anode, the speed V being measured with respect to said moving strip, an electric current corresponding to a current density J greater than 50 A/dm$^2$ is passed between said strip forming the cathode and said anode, which comprises carrying out the deposition under conditions such that:

$J/J_{lim}$ is less than or equal to 0.15, and $J^2/J_{lim}$ is less than or equal to 22 A/dm$^2$ to prevent the formation of edge dendrites on the resulting galvanized metal strip, where $J_{lim}$ is the limiting current density corresponding to the current-density plateau in the current v potential curve characteristic of said plating solution flowing at the speed V in the vicinity of the strip.

2. The continuous process defined in claim 1, wherein $J/J_{lim}$ is less than or equal to 0.15 to limit the rugosity added to the resulting galvanized metal strip to about 0.25 microns or less.

* * * * *